US012202637B2

(12) United States Patent
Wu et al.

(10) Patent No.: US 12,202,637 B2
(45) Date of Patent: Jan. 21, 2025

(54) FILLING AND COVERING MACHINE FOR CENTRIFUGE TUBES WITH TETHERED CAPS

(71) Applicant: EZpack Co., Ltd., Taoyuan (TW)

(72) Inventors: Jui-Che Wu, Taoyuan (TW); Ai-Chen Ho-Yeh, Taoyuan (TW); Chun-Hsien Li, Taoyuan (TW)

(73) Assignee: EZpack Co., Ltd., Taoyuan (TW)

( * ) Notice: Subject to any disclaimer, the term of this patent is extended or adjusted under 35 U.S.C. 154(b) by 0 days.

(21) Appl. No.: 18/506,788

(22) Filed: Nov. 10, 2023

(65) Prior Publication Data

US 2024/0174388 A1 May 30, 2024

(30) Foreign Application Priority Data

Nov. 28, 2022 (TW) ..... 111145484

(51) Int. Cl.

| | |
|---|---|
| ***B65B 7/28*** | (2006.01) |
| ***B65B 3/00*** | (2006.01) |
| ***B65B 3/12*** | (2006.01) |
| ***B65B 43/50*** | (2006.01) |
| ***B65B 57/04*** | (2006.01) |
| ***B65B 61/28*** | (2006.01) |

(52) U.S. Cl.

CPC ..... *B65B 3/003* (2013.01); *B65B 3/12* (2013.01); *B65B 7/28* (2013.01); *B65B 43/50* (2013.01); *B65B 57/04* (2013.01); *B65B 61/28* (2013.01)

(58) Field of Classification Search

CPC ..... B65B 43/50; B65B 43/46; B65B 3/003; B65B 7/28; B65B 7/2821; B65B 57/04

See application file for complete search history.

(56) References Cited

U.S. PATENT DOCUMENTS

| | | | | |
|---|---|---|---|---|
| 5,042,141 | A * | 8/1991 | Dickinson | B65B 7/28 29/776 |
| 6,915,823 | B2 * | 7/2005 | Osborne | B65B 7/2821 604/407 |
| 7,117,902 | B2 * | 10/2006 | Osborne | B65B 3/003 604/407 |
| 7,240,699 | B2 * | 7/2007 | Osborne | B65B 3/003 604/416 |
| 10,688,021 | B2 * | 6/2020 | Tribble | A61J 1/10 |

FOREIGN PATENT DOCUMENTS

CN 113788175 A * 12/2021

* cited by examiner

*Primary Examiner* — Andrew M Tecco

(74) *Attorney, Agent, or Firm* — Blank Rome LLP

(57) ABSTRACT

A filling and covering machine for centrifuge tubes with tethered caps includes a conveying device, a cap-flapping device, a filling device, and a cap-pressing device. The cap-flapping device has an upper planar surface and a cap-guiding member having a starting end portion, an ending end portion that is opposite to the starting end portion, and a guiding surface extending from the starting end portion to the ending end portion, and cooperates with the upper planar surface to define an included angle therebetween decreasing gradually from the starting end portion to the ending end portion to guide a cap of each of the centrifuge tubes with tethered caps toward a tube body thereof.

10 Claims, 10 Drawing Sheets

FILLING AND COVERING MACHINE FOR CENTRIFUGE TUBES WITH TETHERED CAPS

CROSS-REFERENCE TO RELATED APPLICATION

This application claims priority to Taiwanese Invention Patent Application No. 111145484, filed on Nov. 28, 2022, which is incorporated by reference herein in its entirety.

FIELD

The disclosure relates to a filling and covering machine, and more particularly to a filling and covering machine for centrifuge tubes with tethered caps.

BACKGROUND

In the scientific field of medicine, biology, etc., centrifuge tubes are commonly used to carry reagents, medicaments or suspensions. Generally, a cap and a tube body of a centrifuge tube are independently manufactured. Therefore, a filling and assembly machine that has a relatively complicated structure is designed to assemble the cap and the tube body together. Another type of a centrifuge tube with a tethered cap is provided to simplify a structure of the filling and assembly machine.

Referring to FIG. 1, Chinese Patent Publication No. CN113788175A discloses a conventional filling machine for centrifuge tubes with tethered caps that sequentially performs processes of tube arrangement, fluid injection and cap covering of centrifuge tubes with covers. In the cap covering process, a cap flap unit 100 of the conventional filling machine is initially used to downwardly press a cap of the centrifuge tube with the tethered cap on the tube body.

The cap flap unit 100 includes a sliding rail 101, a slidable seat 102, a limiting block 103, a pushing rod 104, two limiting wheels 105, a cap pressing wheel 106, a front cylinder 107, and a rear cylinder 108. The limiting block 103 is disposed on the slidable seat 102, and has two limiting grooves 109 that are spaced apart from each other in a left-right direction and each having an inverted-L shape. The limiting wheels 105 are connected rotatably to a front portion (i.e., the left side in FIG. 1) of the pushing rod 104 and are respectively slidable along the limiting grooves 109. The cap pressing wheel 106 is disposed at the front portion of the pushing rod 104 and is disposed between the limiting wheels 105 for pressing the cap of each of the centrifuge tubes. The front cylinder 107 drives the pushing rod 104 to move such that the limiting wheels 105 slide respectively along the limiting grooves 109 and the cap pressing wheel 106 moves together with the limiting wheels 105. To initially press the cap of each of the centrifuge tubes with tethered caps on the tube body, one of the centrifuge tubes with tethered caps (not shown) is brought to be adjacent to the limiting wheels 105 of the cap flap unit 100, and the pushing rod 104 is moved to enable sliding movement of the limiting wheels 105. By virtue of a structure of the limiting grooves 109, the cap pressing wheel 106 first pushes the cap of the centrifuge tube upwardly, and then continues to push the cap toward the tube body. The rear cylinder 108 is for driving the slidable seat 102 to move along the sliding rail 101 to adjust a distance between each of the centrifuge tubes with tethered caps and the cap pressing wheel 106 so as to press centrifuge tubes with tethered caps having different sizes.

However, a travelling path of the cap pressing wheel 106 is limited by a shape of the limiting grooves 109, and a contact area between the cap and the cap pressing wheel 106 is relatively small. In a case where the cap is not properly arranged and is not aligned with the cap pressing wheel 106, the cap flap unit 100 of the conventional filling machine may not properly press the cap of each of the centrifuge tubes with tethered caps on the tube body. In addition, a structure of the cap flap unit 100 is also complicated.

SUMMARY

Therefore, an object of the disclosure is to provide a filling and covering machine for centrifuge tubes with tethered caps that can alleviate at least one of the drawbacks of the prior art.

According to the disclosure, a filling and covering machine for centrifuge tubes with tethered caps is provided. Each of the centrifuge tubes includes a tube body and a cap connected to the tube body. The filling and covering machine is adapted for filling a fluid into the tube body of each of the centrifuge tubes with tethered caps and covering the cap of each of the centrifuge tubes with tethered caps toward the tube body, and includes a conveying device, a cap-flapping device, a filling device, and a cap-pressing device. The conveying device is adapted for conveying the centrifuge tubes with tethered caps, includes a plurality of positioning members spaced apart from each other and each adapted for positioning the tube body of one of the centrifuge tubes with tethered caps, and has an upper end surface. The cap-flapping device has an upper planar surface and a cap-guiding member. The upper planar surface is substantially parallel to the upper end surface. The cap-guiding member is disposed adjacent to the conveying device and has a starting end portion, an ending end portion, and a guiding surface. The ending end portion is opposite to the starting end portion. The guiding surface extends from the starting end portion to the ending end portion, and cooperates with the upper planar surface to define an included angle therebetween decreasing gradually from the starting end portion to the ending end portion. The positioning members of the conveying device are movable relative to the guiding surface of the cap-guiding member from the starting end portion to the ending end portion. The filling device is disposed between the starting end portion and the ending end portion of the cap-guiding member, and is adapted for injecting the fluid into the tube body of each of the centrifuge tubes with tethered caps. The cap-pressing device is disposed adjacent to the ending end portion of the cap-guiding member, and is adapted for pressing the cap of each of the centrifuge tubes with tethered caps on the tube body.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
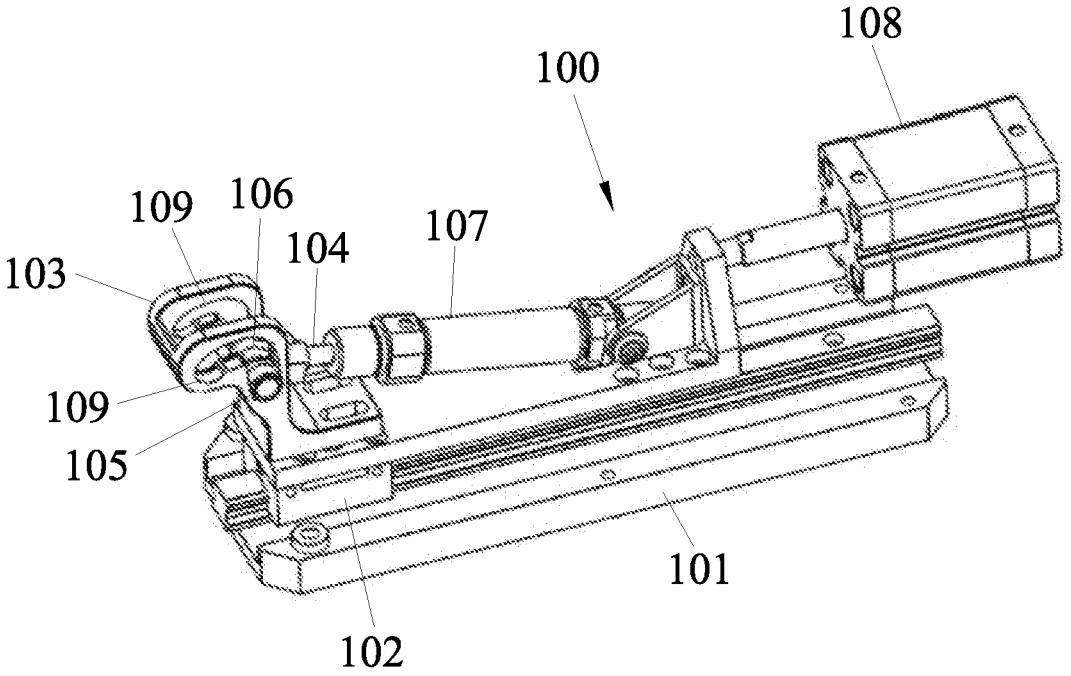
FIG.1 PRIOR ART
FIG. 1 is a perspective view, illustrating a cap flap unit of a conventional filling machine for centrifuge tubes with tethered caps disclosed in Chinese Patent No. CN113788175A.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently e.g., rotated 90 degrees or at other orientations and the spatially relative terms used herein may be interpreted accordingly.

Figure 2:
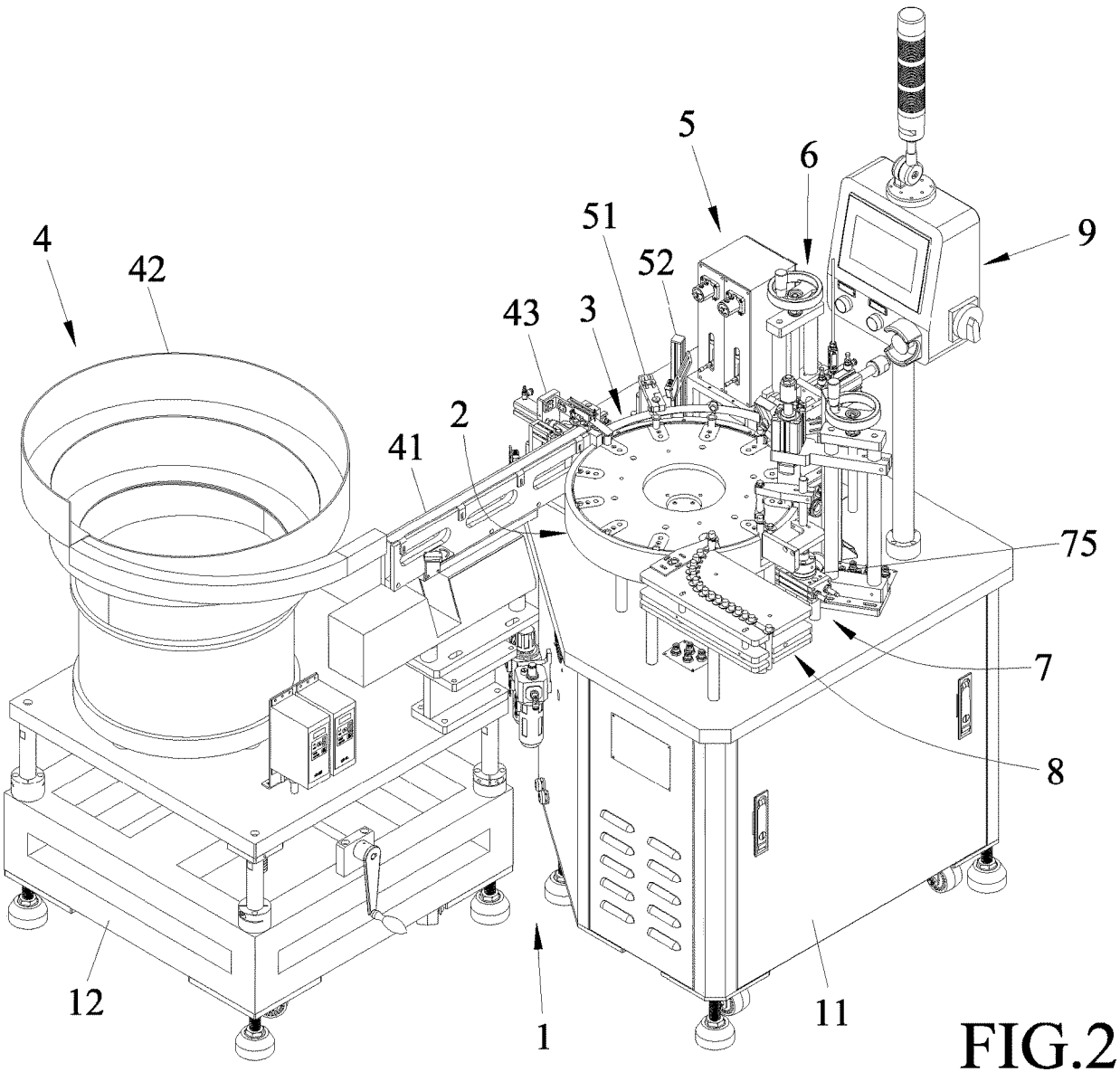
FIG. 2 is a perspective view of a filling and covering machine for centrifuge tubes with tethered caps according to an embodiment of the present disclosure.
Figure 3:
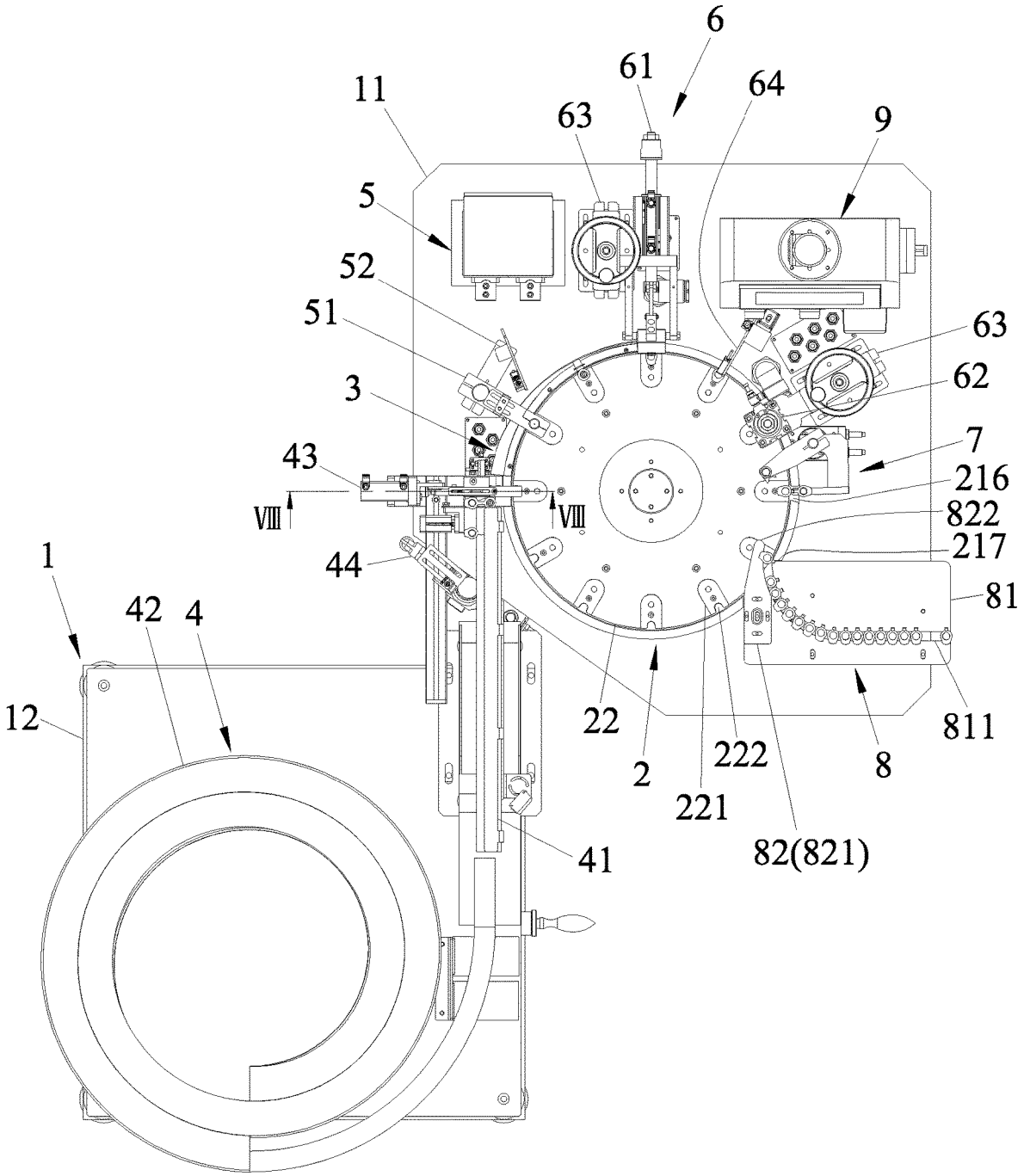
FIG. 3 is a top view of the embodiment.
Figure 4:
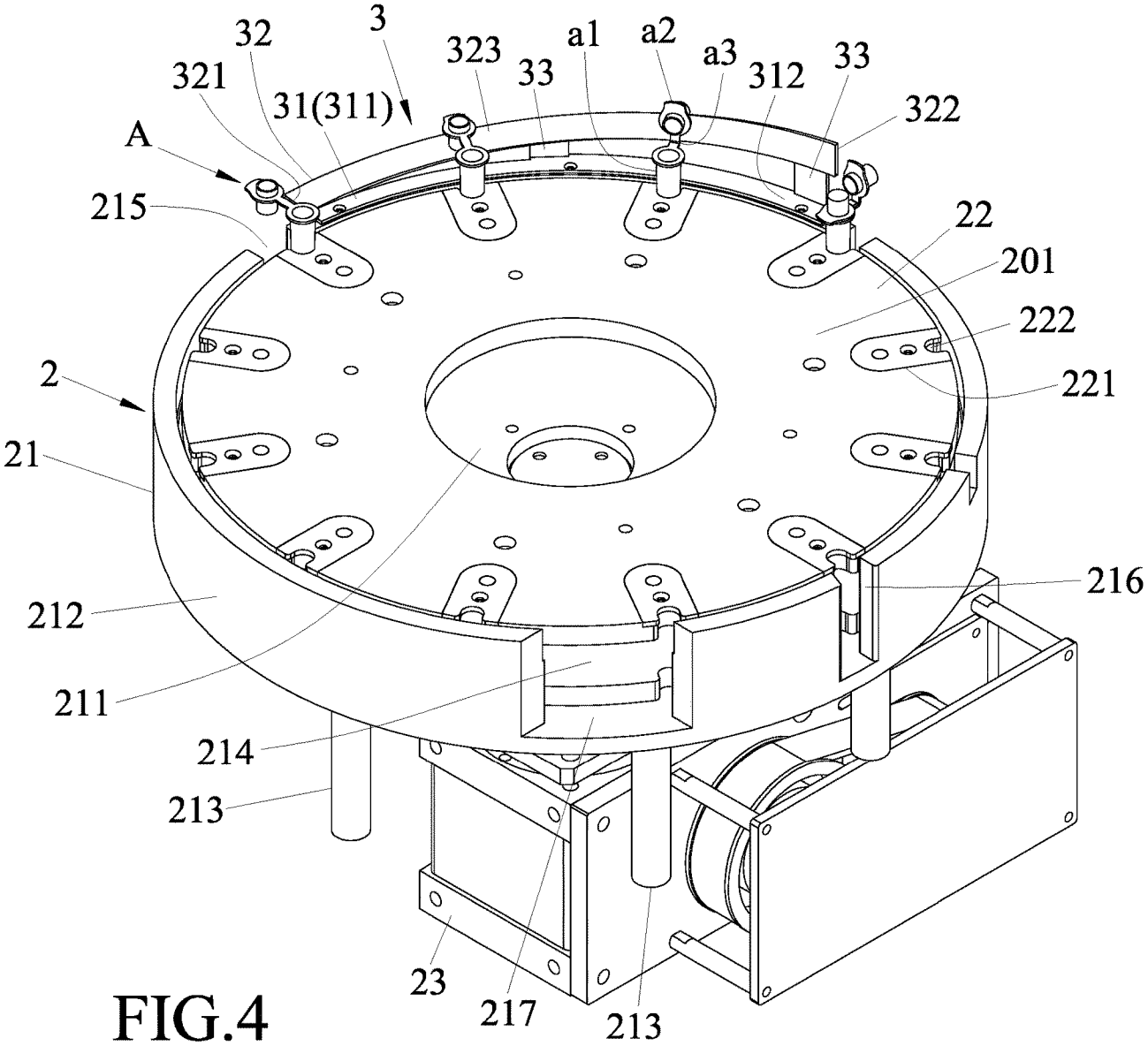
FIG. 4 is a perspective view of a conveying device and a cap-flapping device of the embodiment, illustrating the centrifuge tubes being disposed on the conveying device.

Referring to FIGS. 2 to 4, a filling and covering machine for centrifuge tubes (A) with tethered caps of an embodiment according to the present disclosure is provided. Each of the centrifuge tubes (A) with tethered caps includes a tube body (a1) and a cap (a2) connected to the tube body (a1). The filling and covering machine of the embodiment is adapted for filling a fluid (not shown) into the tube body (a1) of each of the centrifuge tubes (A) with tethered caps, and for covering the cap (a2) of each of the centrifuge tubes (A) with tethered caps. Each of the centrifuge tubes (A) with tethered caps further includes a tether (a3) interconnecting the tube body (a1) and the cap (a2). The fluid may be liquid pharmaceuticals or reagents, etc. In the following description, since a structure of each of the centrifuge tubes (A) with tethered caps is identical, only one of the centrifuge tubes (A) with tethered caps will be described for the sake of brevity.

The filling and covering machine includes a base seat 1, a conveying device 2, a cap-flapping device 3, a feeding device 4, a filling device 5, a cap-pressing device 6, a discarding device 7, a collecting device 8, and a control device 9.

The base seat 1 includes a conveying base 11 and a feeding base 12 disposed adjacent to the conveying base 11.

The conveying device 2 is disposed on the conveying base 11, and includes a conveying frame 21, a rotary disc 22, and a conveying driving assembly 23.

The conveying frame 21 has a circular base wall 211, a surrounding wall 212 extending upwardly from a periphery of the circular base wall 211 and cooperating with the circular base wall 211 to define a rotating space 214, and a plurality of support legs 213 extending downwardly from the circular base wall 211 and supported by the conveying base 11. As shown in FIG. 4, the surrounding wall 212 has an inlet opening 215, a discarding opening 216, and an outlet opening 217 that are spaced apart from each other, that are arranged sequentially in a clockwise direction, and that are in spatial communication with the rotating space 214.

The rotary disc 22 is rotatably disposed in the rotating space 214, has an upper end surface 201, and includes a plurality of positioning members 221 disposed on a periphery of the rotary disc 22 and spaced apart from each other. Each of the positioning members 221 is adapted for positioning the tube body (a1) of the centrifuge tube (A) with tethered cap and has a retaining groove 222 that opens outwardly. Specifically, the retaining groove 222 of each of the positioning members 221 is adapted for retaining the tube body (a1) of the centrifuge tube (A) with tethered cap therein.

The conveying driving assembly 23 is disposed in the conveying base 11, and is operable to drive rotation of the rotary disc 22.

Figure 5:
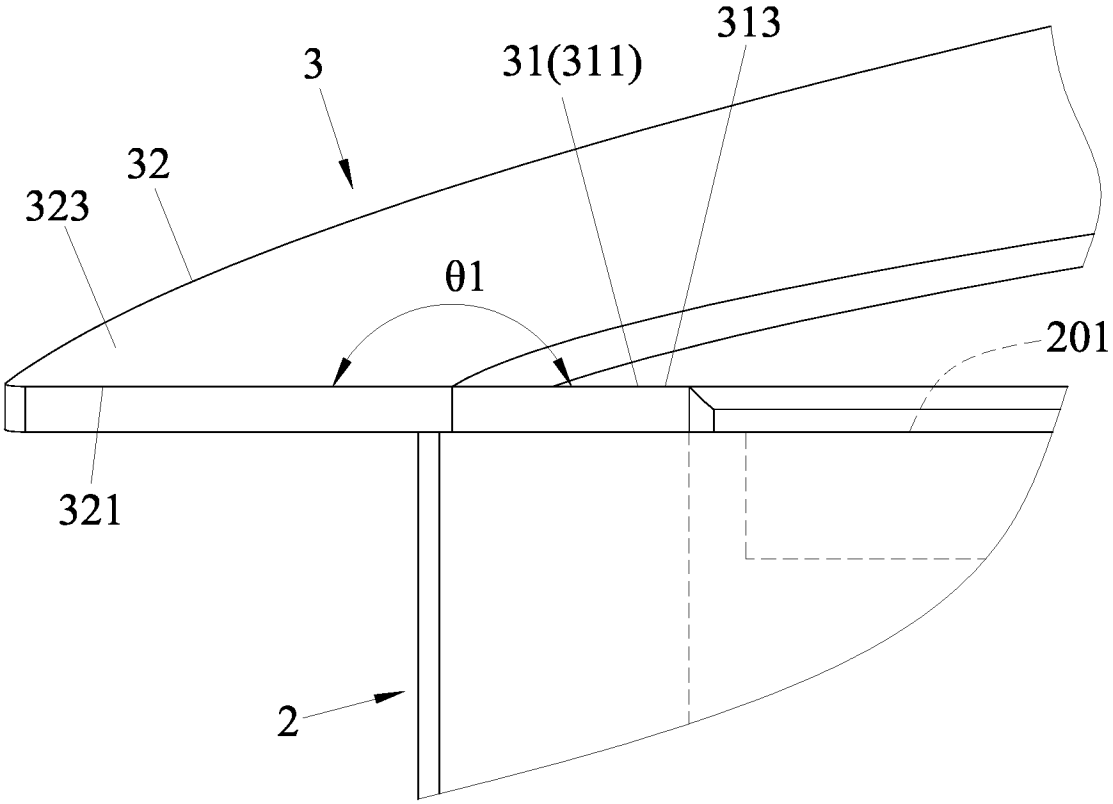
FIG. 5 is a fragmentary side view of FIG. 4, illustrating a starting end portion of the cap-flapping device.
Figure 6:
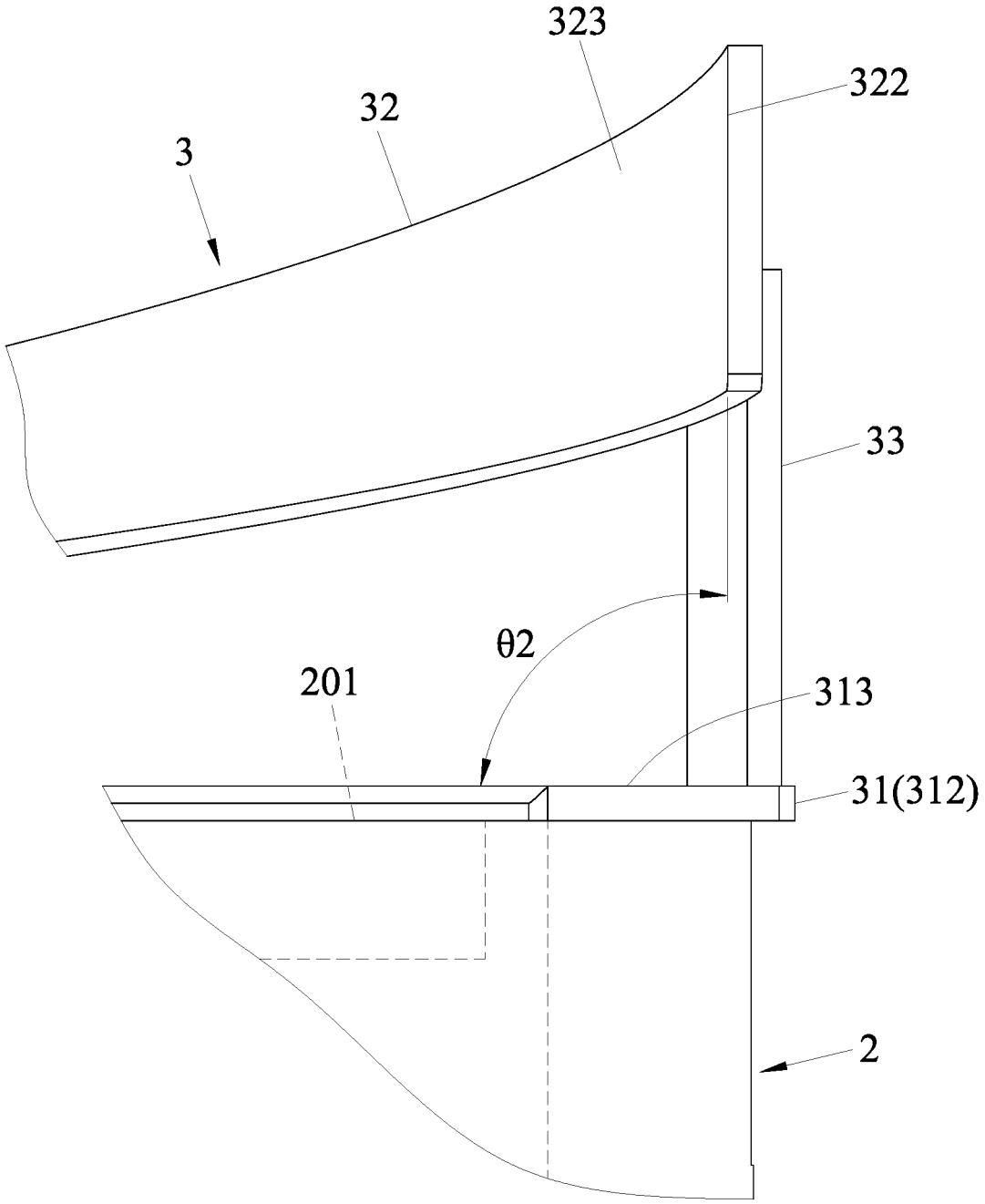
FIG. 6 is another fragmentary side view of FIG. 4, illustrating an ending end portion of the cap-flapping device.

Referring to FIGS. 4, 5 and 6, the cap-flapping device 3 includes a base plate 31, a cap-guiding member 32, and two support plates 33.

The base plate 31 is arcuate, is disposed on a top portion of the surrounding wall 212 of the conveying frame 21, and has a first end portion 311, a second end portion 312 disposed opposite to the first end portion 311 in the clockwise direction, and an upper planar surface 313 extending from the first end portion 311 to the second end portion 312 and substantially parallel to the upper end surface 201. The first end portion 311 is disposed adjacent to the inlet opening 215, and the second end portion 312 is disposed between the first end portion 311 and the discarding opening 216.

The cap-guiding member 32 is configured as a thin board and extends along the surrounding wall 212. The cap-guiding member 32 is disposed adjacent to the conveying device 2 and has a starting end portion 321 disposed adjacent to the first end portion 311 of the base plate 31, an ending end portion 322 opposite to the starting end portion 321 in the clockwise direction, and a guiding surface 323 extending from the starting end portion 321 to the ending end portion 322. In this embodiment, the guiding surface 323 is a continuously curved surface, and the starting end portion 321 is substantially parallel to the upper end surface 201 and is connected to an outer side of the first end portion 311 of the base plate 31. A minimum distance between an uppermost end of the cap guiding member 32 and the upper end surface 201 increases gradually from the starting end portion 321 to the ending end portion 322. The ending end portion 322 is disposed above the upper end surface 201 of the conveying device 2 and the second end portion 312, and is substantially perpendicular to the upper end surface 201.

The guiding surface 323 cooperates with the upper planar surface 313 of the base plate 31 to define an included angle therebetween decreasing gradually from the starting end portion 321 to the ending end portion 322. Specifically, the starting end portion 321 of the guiding surface 323 cooperates with the upper planar surface 313 of the base plate 31 to define a first included angle (θ1) therebetween. The ending end portion 322 of the guiding surface 323 cooperates with the upper planar surface 313 to define a second included angle (θ2) therebetween. In this embodiment, the first included angle (θ1) is substantially equal to 180 degrees, and the second included angle (θ2) is substantially equal to 90 degrees, i.e., $\theta 1 \approx 180°$ and $\theta 2 \approx 90°$, to meet a requirement of variation in angle between the cap (a2) and the tube body (a1) of the centrifuge tube (A) with tethered cap. In other embodiments, the first included angle (θ1) and the second included angle (θ2) may be adjusted according to different requirements, for example, the first included angle (θ1) is not smaller than 180 degrees, and the second included angle (θ2) is not smaller than 65 degrees and is not greater than 90 degrees, i.e., $\theta 1 \geq 180°$ and $65° \leq \theta 2 \leq 90°$.

The support plates 33 are disposed between and interconnect the cap-guiding member 32 and the base plate 31, and cooperate with the base plate 31 to support the cap-guiding member 32.

It should be noted that, in this embodiment, the conveying device 2 conveys the centrifuge tube (A) with tethered cap through rotation of the rotary disc 22 that is driven by the conveying driving assembly 23 so that each of the positioning members 221 is movable relative to the guiding surface 323 of the cap-guiding member 32 from the starting end portion 321 to the ending end portion 322. In this embodiment, the cap-flapping device 3, the feeding device 4, the filling device 5, the cap-pressing device 6, the discarding device 7, and the collecting device 8 are disposed adjacent to and surround the rotary disc 22, so an overall size occupied by the filling and covering machine is relatively small. However, in other variations, the conveying device 2 may be configured to convey the centrifuge tubes (A) with tethered caps that are linearly arranged in a manner of linear movement, and the cap-flapping device 3 may extend along the conveying device 2. It should be noted that arrangement of the conveying device 2 and the cap-flapping device 3 may be altered to meet different requirements, and is not limited to the examples described herein.

Figure 7:
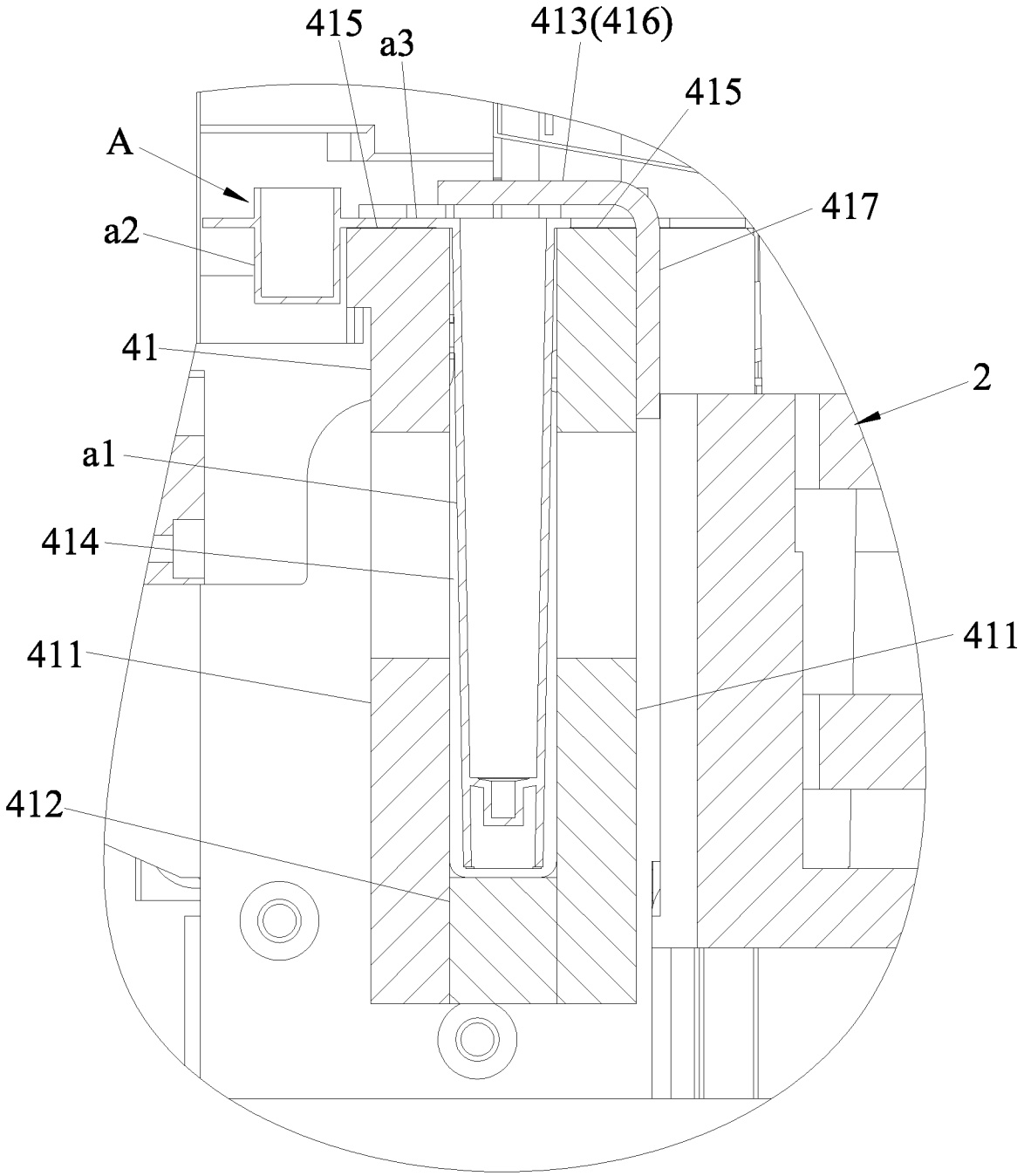
FIG. 7 is a fragmentary sectional view, illustrating a tube-arranging track of a feeding device of the embodiment.
Figure 8:
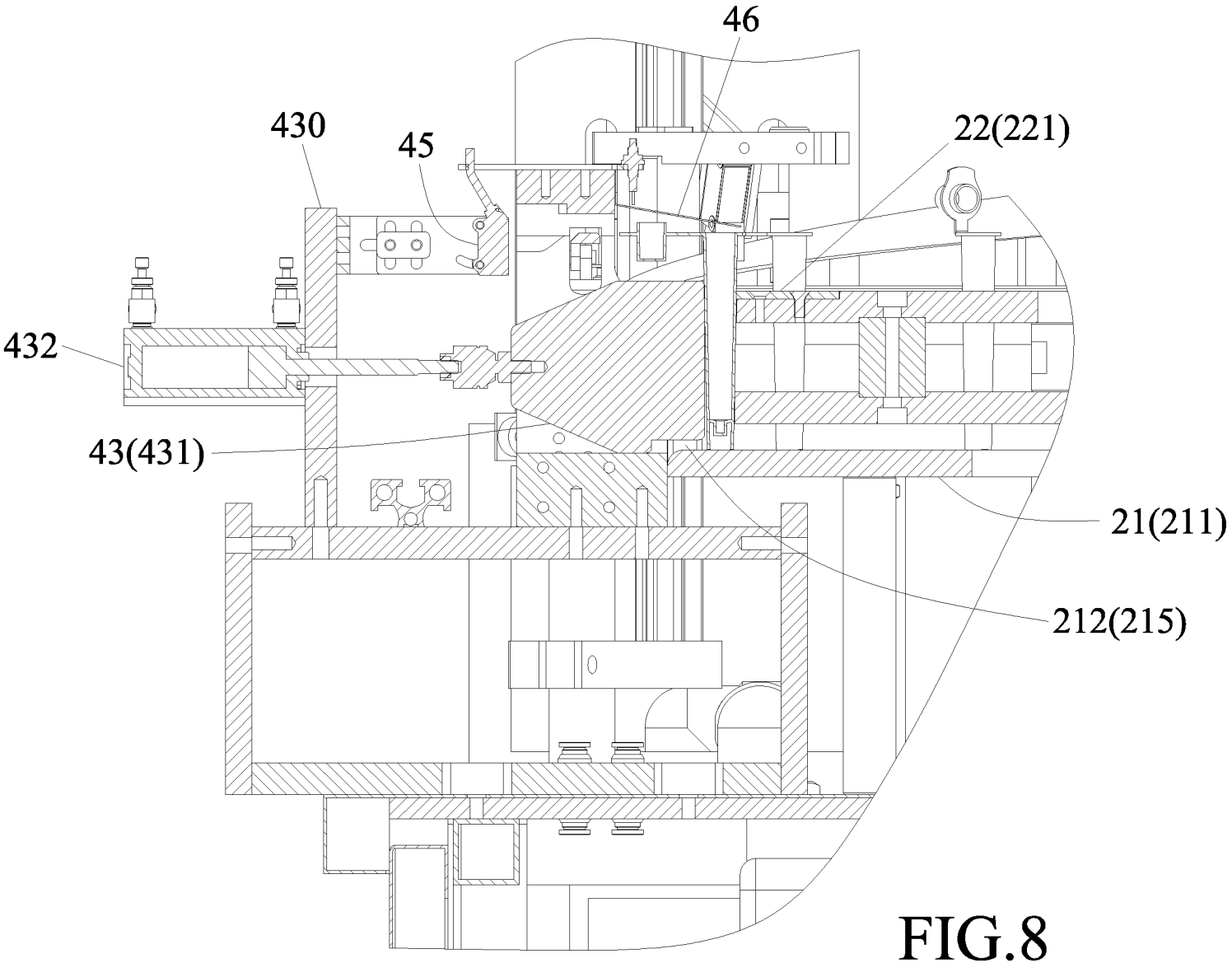
FIG. 8 is a fragmentary sectional view taken along line VIII-VIII in FIG. 3.

Referring to FIGS. 3, 7 and 8, the feeding device 4 is disposed adjacent to the starting end portion 321 of the cap-guiding member 32. The feeding device 4 is adapted for feeding the centrifuge tube (A) with tethered cap to the positioning members 221, and includes a feeding module 42, a tube-arranging track 41, a feeder 43, a quantity sensor 44, a feeding sensor 45, and a resilient plate 46.

The feeding module 42 is disposed on the feeding base 12 and is operable to be vibrated. In this embodiment, the feeding module 42 is a vibrator bowl, and is adapted for conveying the centrifuge tube (A) with tethered cap to the tube-arranging track 41 and driving the tube-arranging track 41 to vibrate.

The tube-arranging track 41 is disposed downstream of and vibrated by the feeding module 42, is located between the feeding module 42 and the feeder 43, and includes two guiding rails 411, a rail bottom plate 412, and a blocking plate 413. The guiding rails 411 are spaced apart from each other, and one of the guiding rails 411 is disposed farther from the conveying device 2 than the other one of the guiding rails 411. As shown in FIG. 7, the one of the guiding rails 411, which is referred to as the left one of the guiding rails 411 in the following description, has a top surface 415 adapted for abutting against the tether (a3) of the centrifuge tube (A) with tethered cap, and a width of the top surface 415 in a direction perpendicular to an extension direction of the guiding rail 411 is substantially the same as a length of the tether (a3), i.e., a minimum distance between the cap (a2) and the tube body (a1) of the centrifuge tube (A) with tethered cap. The rail bottom plate 412 is disposed between bottom portions of the guiding rails 411. The guiding rails 411 and the rail bottom plate 412 cooperatively define a guide groove 414 thereamong. In this way, during vibration of the feeding module 42 and thus vibration of the tube-arranging track 41, the centrifuge tube (A) with tethered cap moves along the guide groove 414 toward the feeder 43. The blocking plate 413 has a blocking portion 416 disposed above the guiding rails 411 and covering a top surface 415 of a right one of the guiding rails 411, and a plurality of positioning portions 417 (only one is visible in FIG. 7) extending downwardly from one side of the blocking portion 416 that is away from a left one of the guiding rails 411 and fixedly connected to the right one of the guiding rails 411.

By virtue of the blocking plate 413 covering the top surface 415 of the right one of the guiding rails 411, when the centrifuge tube (A) with tethered cap enters the guide groove 414, the cap (a2) of the centrifuge tube (A) with tethered cap is guided by the blocking portion 416 of the blocking plate 413 and is thus located outwardly of the left one of the guiding rails 411. In addition, since the width of the top surface 415 is substantially the same as the length of the tether (a3) of the centrifuge tube (A) with tethered cap, the cap (a2) of the centrifuge tube (A) with tethered cap is orderly arranged at an outer side of the left one of the guiding rails 411.

The feeder 43 is disposed downstream of the tube-arranging track 41 on the conveying base 11, is adjacent to the inlet opening 215 of the conveying device 2, and is adapted for feeding the centrifuge tube (A) with tethered cap to the positioning members 221. In this embodiment, the feeder 43 is adapted to push the centrifuge tubes (A) with tethered caps into the positioning members 221 one by one. As shown in FIG. 8, the feeder 43 includes a feeder rack 430, a pushing block 431, and a feeding driver 432. The feeder rack 430 is disposed on the conveying base 11 and is adjacent to the inlet opening 215. The pushing block 431 is movable toward the inlet opening 215 and is adapted to push the centrifuge tube (A) with tethered cap into one of the positioning members 221 through the inlet opening 215. The feeding driver 432 is disposed on the feeder rack 430 and is operable to drive movement of the pushing block 431.

The quantity sensor 44 is mounted to the feeder rack 430, is disposed adjacent to the tube-arranging track 41, and is adapted to sense a number of the centrifuge tubes (A) with tethered caps disposed in the tube-arranging track 41. In this embodiment, the quantity sensor 44 is a photoelectric sensor.

The feeding sensor 45 is mounted to the feeder rack 430 and is disposed adjacent to and faces the inlet opening 215. The feeding sensor 45 is adapted for detecting whether the centrifuge tube (A) with tethered cap conveyed in the tube-arranging track 41 is moved adjacent to the inlet opening 215. In this embodiment, the feeding sensor 45 is a photoelectric sensor.

The resilient plate 46 is mounted to the feeder rack 430 and extends above the inlet opening 215. The resilient plate 46 is adapted to limit a height of the centrifuge tube (A) with tethered cap disposed relative to the inlet opening 215 to prevent the centrifuge tube (A) with tethered cap from colliding with subsequent components.

Referring back to FIG. 2, the filling device 5 is disposed between the starting end portion 321 and the ending end portion 322 of the cap-guiding member 32. The filling device 5 includes a filler 51 corresponding in position to one of the positioning members 221 and adapted for injecting the fluid into the tube body (a1) of the centrifuge tube (A) with tethered cap, and a filling sensor 52 adapted for sensing whether the centrifuge tube (A) with tethered cap is disposed in one of the positioning members 221 that the filler 51 corresponds in position to. In this embodiment, the filler 51 is a pump, and the filling sensor 52 is a photoelectric sensor.

Figure 9:
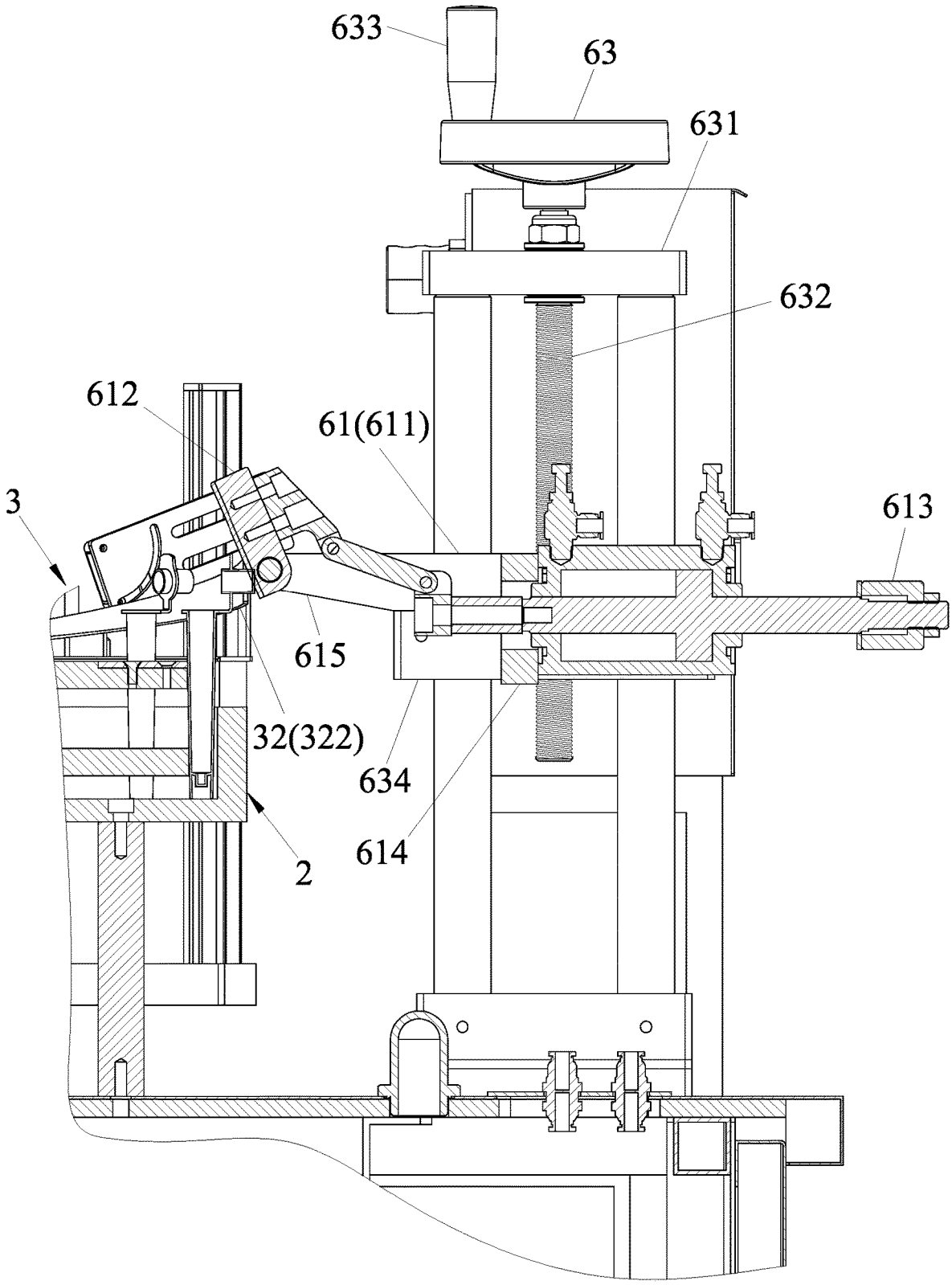
FIG. 9 is a fragmentary sectional view of a pre-pressing device and a height-adjusting member of a cap-pressing device of the embodiment.
Figure 10:
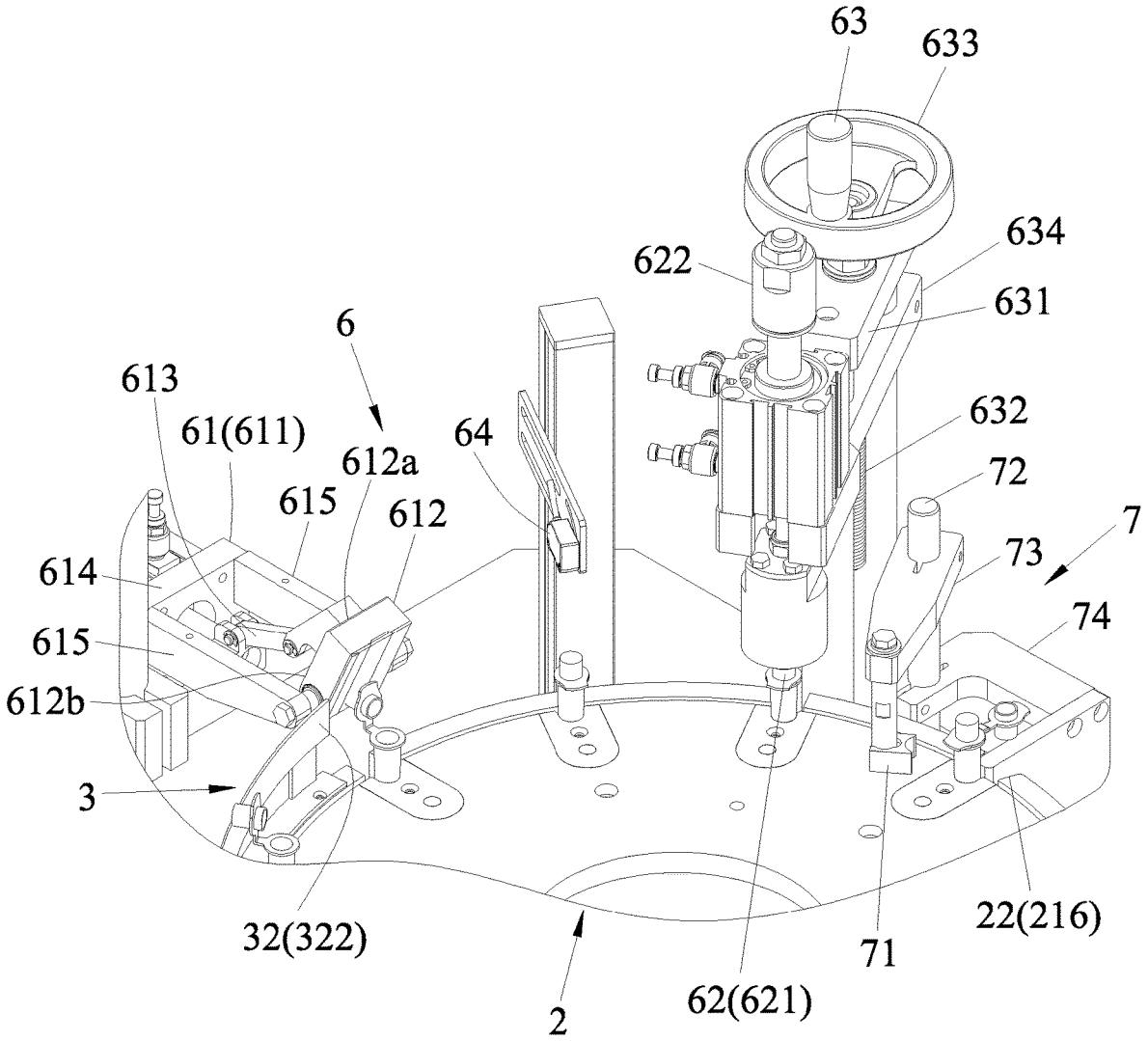
FIG. 10 is a fragmentary perspective view illustrating a discarding device and the cap-pressing device of the embodiment disposed adjacent to the conveying device.

Referring back to FIG. 3 and further referring to FIGS. 9 and 10, the cap-pressing device 6 is disposed on the conveying base 11, and is adapted for pressing the cap (a2) of the centrifuge tube (A) with tethered cap on the tube body (a1). The cap-pressing device 6 includes a pre-pressing device 61, a pressing device 62, two height-adjusting members 63, and a cap-pressing sensor 64.

The pre-pressing device 61 is disposed adjacent to the ending end portion 322 of the cap-guiding member 32 and includes a pre-pressing frame 611, a pre-pressing plate 612 and a pre-pressing driving assembly 613. The pre-pressing frame 611 has a front portion disposed adjacent to the conveying device 2. The pre-pressing plate 612 has a front end portion 612*a* adjacent to the conveying device 2, and a rear end portion 612*b* opposite to the conveying device 2 and connected pivotably to the front portion of the pre-pressing frame 611. In this embodiment, the pre-pressing frame 611 includes a mounting plate 614, and two lateral plates 615 extending respectively from two lateral sides of the mounting plate 614 toward the conveying device 2, disposed adjacent to the conveying device 2, and having the front portion of the pre-pressing frame 611. Specifically, the rear end portion 612*b* of the pre-pressing plate 612 is connected pivotably to front ends of the lateral plates 615. The pre-pressing driving assembly 613 is mounted to the pre-pressing frame 611, is connected to the front end portion 612*a* of the pre-pressing plate 612, and is operable to drive the pre-pressing plate 612 to pivot relative to the pre-pressing frame 611 and thus the conveying device 2 via pivot connection among the lateral plates 615 and the rear end portion 612*b* of the pre-pressing plate 612. In this way, the pre-pressing plate 612 is adapted for guiding and pre-pressing the cover (a2) of the centrifuge tube (A) with tethered cap on the tube body (a1).

The pressing device 62 is disposed between the pre-pressing device 61 and the discarding device 7 in the clockwise direction, and has a pressing member 621 and a pressing driving assembly 622. The pressing member 621 is vertically movable, and is adapted for tightly pressing the cover (a2) of the centrifuge tube (A) with tethered cap on the tube body (a1). The pressing driving assembly 622 is operable to drive vertical movement of the pressing member 621.

The height-adjusting members 63 are connected respectively to the pre-pressing device 61 and the pressing device 62, and are operable to respectively adjust a height of the pre-pressing device 61 and a height of the pressing device 62 relative to the conveying device 2. Each of the height-adjusting members 63 includes a mounting frame 631, a threaded rod 632 rotatably mounted to the mounting frame 631, a hand wheel 633 connected fixedly to a top portion of the threaded rod 632 and accessible to drive rotation of the threaded rod 632, and an adjusted block 634 mounted movably to the mounting frame 631 along the threaded rod 632 and threadedly engaging the threaded rod 632. Rotation of the hand wheel 633 drives rotation of the threaded rod 632, and thus the adjusted block 634 is moved along the threaded rod 632 relative to the mounting frame 631. In this embodiment, the pre-pressing device 61 and the pressing device 62 are mounted co-movably to the adjusted blocks 634 of the height-adjusting members 63, respectively. In this way, the heights of the pre-pressing device 61 and the pressing device 62 respectively relative to the conveying device 2 may be simply adjusted to accommodate the centrifuge tubes (A) with tethered caps having different sizes.

The cap-pressing sensor 64 is disposed between the pre-pressing device 61 and the pressing device 62 in the clockwise direction, and is adapted for detecting a distance between the cap-pressing sensor 64 and the cap (a2) of the centrifuge tube (A) with tethered cap. In this embodiment, the cap-pressing sensor 64 is a laser sensor.

The discarding device 7 is disposed downstream of the cap-pressing device 6, is adjacent to the discarding opening 216 of the surrounding wall 212 of the conveying device 2, and is adapted for removing the centrifuge tube (A) with tethered cap from the retaining groove 222 of one of the positioning members 221. As show in FIG. 10, the discarding device 7 includes a pushing member 71, a rotatable shaft 72, a connecting arm 73, a blocking arm 74, and a discard driving assembly 75 (see FIG. 2). The pushing member 71 is movable relative to the conveying device 2 and is adapted for pushing the centrifuge tube (A) with tethered cap out of the retaining groove 222 of one of the positioning members 221. The rotatable shaft 72 is rotatable about an axis of the rotatable shaft 72. The connecting arm 73 has two opposite ends respectively and fixedly connected to the pushing member 71 and the rotatable shaft 72, and is driven by rotation of the rotatable shaft 72 to move the pushing member 71 relative to the conveying device 2. The blocking arm 74 is generally U-shaped, and is co-rotatably connected to the rotatable shaft 72 to move relative to the conveying device 2 for covering and uncovering the discarding opening 216. The discard driving assembly 75 (see FIG. 2) is operable to drive the rotation of the rotatable shaft 72 such that the pushing member 71 rotates about the rotatable shaft 72. In a case where the centrifuge tube (A) with tethered cap does not satisfy a certain criteria and is to be discarded, the discard driving assembly 75 drives the rotation of the rotatable shaft 72, and thus the pushing member 71 and the blocking arm 74 rotate about the rotatable shaft 72 away from the conveying device 2. At this position, the blocking arm 74 is away from and uncovers the discarding opening 216, and the pushing member 71 pushes the centrifuge tube (A) with tethered cap out of the retaining groove 222 of one of the positioning members 221 via the discarding opening 216.

In this embodiment, each of the conveying driving assembly 23, the feeding driver 432, the pre-pressing driving assembly 613, the pressing driving assembly 622, and the discard driving assembly 75 is a pneumatic cylinder and the present disclosure is not limited hereto.

The collecting device 8 is disposed downstream of the cap-pressing device 6 on the conveying base 11, and is adjacent to the outlet opening 217 of the conveying device 2. The collecting device 8 includes a collecting base 81 and a guiding plate 82. The collecting base 81 includes a collecting groove 811 in spatial communication with the outlet opening 217 and extending curvedly away from the conveying device 2. The guiding plate 82 has a fixed portion 821 connected fixedly to a top portion of the collecting base 81, and a guiding portion 822 extending from the fixed portion 821 into the outlet opening 217 and configured to guide the centrifuge tube (A) with tethered cap into the collecting groove 811.

The control device 9 is electrically connected to the conveying driving assembly 23, the feeding module 42, the feeding driver 432, the quantity sensor 44, the feeding sensor 45, the filler 51, the filling sensor 52, the pre-pressing driving assembly 613, the pressing driving assembly 622, the cap-pressing sensor 64 and the discard driving assembly 75, and is configured to control operations of the same. In this embodiment, the control device 9 is a microcontroller or a controller such as, but not limited to, a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc.

A procedure of filling and covering a plurality of centrifuge tubes (A) with tethered caps by the filling and covering machine of the embodiment of the present disclosure is described in the following.

First, the feeding module 42 is vibrated to transport the centrifuge tubes (A) with tethered caps to the inlet opening 215 via the tube-arranging track 41. When the feeding sensor 45 detects that one of the centrifuge tubes (A) with tethered caps conveyed in the tube-arranging track 41 is moved adjacent to the inlet opening 215, the control device 9 controls the feeding driver 432 to drive the pushing block 431 to push the one of the centrifuge tubes (A) with tethered caps from the inlet opening 215 toward one of the positioning members 221 into the retaining groove 222 of the one of the positioning members 221. Subsequently, the conveying driving assembly 23 drives rotation of the rotary disc 22 in the clockwise direction such that the one of the centrifuge tubes (A) with tethered caps moves away from the inlet opening 215. After the one of the centrifuge tubes (A) with tethered caps is moved away from the inlet opening 215, the control device 9 controls the feeding driver 432 to move the pushing block 431 out of the inlet opening 215. At this stage, when the quantity sensor 44 senses that the number of the centrifuge tubes (A) with tethered caps disposed in the guide groove 414 of the tube-arranging track 41 is not sufficient to enable the centrifuge tubes (A) with tethered caps to be conveyed along the guide groove 414, the control device 9 controls the feeding module 42 to continuously vibrate to thereby feed the centrifuge tubes (A) with tethered caps into the guide groove 414. On the other hand, when the quantity sensor 44 senses that the number of the centrifuge tubes (A) with tethered caps disposed in the guide groove 414 is greater than a certain number, the control device 9 controls the feeding module 42 to stop vibration and feeding of the centrifuge tubes (A) with tethered caps, thereby preventing the feeding module 42 from making unnecessary noise.

When one of the centrifuge tubes (A) with tethered caps passes by the cap-flapping device 3 during the rotation of the rotary disc 22, since the included angle formed between the guiding surface 323 of the cap-guiding member 32 and the upper planar surface 313 of the base plate 31 gradually decreases from the starting end portion 321 to the ending end portion 322, the cap (a2) of the one of the centrifuge tubes (A) with tethered caps is in contact with and guided by the guiding surface 323. Thus, the tether (a3) of the one of the centrifuge tubes (A) with tethered caps is gradually bent toward the tube body (a1) of the centrifuge tube (A) with tethered cap from the starting end portion 321 to the ending end portion 322. During this process, when the filling sensor 52 senses that the one of the centrifuge tubes (A) with tethered caps is disposed in one of the positioning members 221 corresponding in position thereto, the control device 9 controls the filler 51 to inject the fluid into the tube body (a1). On the contrary, when the filling sensor 52 does not sense existence of the one of the centrifuge tubes (A) with tethered caps in the one of the positioning members 221 corresponding in position thereto, the control device 9 controls the filler 51 not to inject the fluid, i.e., to pause operation of the filler 51.

Hereafter, the control device 9 controls the pre-pressing driving assembly 613 to drive pivot movement of the pre-pressing plate 612 to pre-press the cap (a2) of the one of the centrifuge tubes (A) with tethered caps on the tube body (a1). Then, the pressing driving assembly 622 is controlled by the control device 9 to drive vertical movement of the pressing member 621 so that the cap (a2) is pressed tightly on the tube body (a1).

It should be noted that after the one of the centrifuge tubes (A) with tethered caps is processed by the pre-pressing device 61, the cap-pressing sensor 64 detects a distance between the cap-pressing sensor 64 and the cap (a2). When the distance detected by the cap-pressing sensor 64 is greater than a predetermined value, representing that the cap (a2) is not properly pre-pressed and covered on the tube body (a1), the control device 9 controls the conveying driving assembly 23 and the pressing driving assembly 622 to skip processing of the one of the centrifugal tubes with tethered caps (A), which is then an unqualified centrifugal tube. Specifically, the control device 9 controls the conveying driving assembly 23 to continuously drive the rotation of the rotary disc 22 to skip a process performed by the pressing device 62 and the unqualified centrifugal tube is moved toward the discarding opening 216. At this time, the control device 9 controls the discarding device 7 to push the unqualified centrifugal tube out of the positioning member 221 via the discarding opening 216.

Finally, the centrifuge tubes (A) with tethered caps that are processed by the pressing device 62 are moved to the outlet opening 217, and are guided by the guiding portion 822 of the guiding plate 82 to enter the collecting groove 811 to complete the filling and covering procedure.

By virtue of a design of the cap-guiding member 32, the included angle defined between the guiding surface 323 of the cap-guiding member 32 and the upper planar surface 313 of the base plate 31 gradually decreases from the starting end portion 321 toward the ending end portion 322, even if the cap (a2) of the centrifuge tube (A) with tethered cap is slightly deviated from and is not properly aligned with the guiding surface 323, the cap (a2) may still be guided by the guiding surface 323 gradually toward the tube body (a1) during rotation of the conveying device 2 that drives the centrifuge tube (A) with tethered cap to move from the starting end portion 321 to the ending end portion 322. As compared to the conventional filling machine described in the background section, the present disclosure has a simple structure and may efficiently and effectively cover the cap (a2) of the centrifuge tube (A) on the tube body (a1).

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A filling and covering machine for centrifuge tubes with tethered caps, each of the centrifuge tubes with tethered caps including a tube body and a cap connected to the tube body, said filling and covering machine adapted for filling a fluid into the tube body of each of the centrifuge tubes with tethered caps and covering the cap of each of the centrifuge tubes with tethered caps, said filling and covering machine comprising:

a conveying device that is adapted for conveying the centrifuge tubes with tethered caps, that includes a plurality of positioning members spaced apart from each other and each adapted for positioning the tube body of one of the centrifuge tubes with tethered caps, and that has an upper end surface;

a cap-flapping device that has an upper planar surface substantially parallel to said upper end surface, and a cap-guiding member disposed adjacent to said conveying device and having a starting end portion, an ending end portion that is opposite to said starting end portion, and a guiding surface that extends from said starting end portion to said ending end portion, and that cooperates with said upper planar surface to define an included angle therebetween decreasing gradually from said starting end portion to said ending end portion, each of said positioning members of said conveying device being movable relative to said guiding surface of said cap-guiding member from said starting end portion to said ending end portion;

a filling device that is disposed between said starting end portion and said ending end portion of said cap-guiding member and that is adapted for injecting the fluid into the tube body of each of the centrifuge tubes with tethered caps; and a cap-pressing device that is disposed adjacent to said ending end portion of said cap-guiding member and that is adapted for pressing the cap of one of the centrifuge tubes with tethered caps on the tube body.

2. The filling and covering machine as claimed in claim 1, wherein:

said starting end portion of said guiding surface is substantially parallel to said upper end surface and cooperates with said upper planar surface to define a first included angle therebetween; and said ending end portion is substantially perpendicular to said upper end surface, and cooperates with said upper planar surface to define a second included angle therebetween, where the first included angle is not smaller than 180 degrees, and the second included angle is not smaller than 65 degrees and is not greater than 90 degrees.

3. The filling and covering machine as claimed in claim 2, wherein the first included angle is substantially equal to 180 degrees and the second included angle is substantially equal to 90 degrees.

4. The filling and covering machine as claimed in claim 1, wherein:

a minimum distance between an uppermost end of said cap-guiding member and said upper end surface increases gradually from said starting end portion to said ending end portion; and said ending end portion is disposed above said upper end surface of said conveying device.

5. The filling and covering machine as claimed in claim 1, wherein said cap-pressing device includes:

a pre-pressing device disposed adjacent to said ending end portion of said cap-guiding member, and including a pre-pressing frame that has a front portion disposed adjacent to said conveying device, a pre-pressing plate that has a rear end portion opposite to said conveying device and pivotably connected to said front portion of said pre-pressing frame, and a pre-pressing driving assembly that is mounted to said pre-pressing frame and that is operable to drive said pre-pressing plate to pivot relative to said pre-pressing frame and thus to said conveying device; and a pressing device including a pressing member that is vertically movable, and a pressing driving assembly that is operable to drive vertical movement of said pressing member.

6. The filling and covering machine as claimed in claim 5, wherein said cap-pressing device further includes two height-adjusting members operable to respectively adjust a height of said pre-pressing device and a height of said pressing device relative to said conveying device.

7. The filling and covering machine as claimed in claim 5, wherein said cap-pressing device further includes a cap-pressing sensor disposed between said pre-pressing device and said pressing device, and adapted for detecting a distance between said cap-pressing sensor and the centrifuge tubes with tethered caps.

8. The filling and covering machine as claimed in claim 1, wherein:

said filling and covering machine further comprises a discarding device disposed downstream of said cap-pressing device;

each of said positioning members of said conveying device has a retaining groove which opens outwardly and which is adapted for retaining one of the centrifuge tubes with tethered caps therein; and said discarding device is adapted for removing the one of the centrifuge tubes with tethered caps from said retaining groove of one of said positioning members, and includes a pushing member movable relative to said conveying device and adapted for pushing one of the centrifuge tubes with tethered caps out of said retaining groove, a rotatable shaft rotatable about an axis of said rotatable shaft, a connecting arm having two opposite ends which are respectively connected to said pushing member and said rotatable shaft, and a discard driving assembly operable to drive rotation of said rotatable shaft such that said pushing member rotates about said rotatable shaft.

9. The filling and covering machine as claimed in claim 1, wherein:

said filling and covering machine further comprises a feeding device that is adapted for feeding the centrifuge tubes with tethered caps to said positioning members, that is disposed adjacent to said starting end portion of said cap-guiding member, and that includes a feeding module operable to be vibrated and adapted for conveying the centrifuge tubes with tethered caps, a tube-arranging track disposed downstream of and being vibrated by said feeding module and adapted for arranging the centrifuge tubes with tethered caps to be conveyed from said feeding module, and a feeder disposed downstream of said tube-arranging track and adapted for feeding the centrifuge tubes with tethered caps to said positioning members, said feeding module being adapted for conveying the centrifuge tubes with tethered caps to said tube-arranging track and driving said tube-arranging track to vibrate, so as to convey the centrifuge tubes with tethered caps from said feeding module along said tube-arranging track toward said feeder.

10. The filling and covering machine as claimed in claim 9, further comprising:

a control device that is electrically connected to said conveying device, said filling device, said cap-pressing device, and said feeding device; wherein said feeding device further includes a quantity sensor disposed adjacent to said tube-arranging track and adapted for sensing a number of the centrifuge tubes with tethered caps in said tube-arranging track; and said control device is configured to, when said quantity sensor senses that the number of the centrifuge tubes with tethered caps disposed in said tube-arranging track exceeds a predetermined number, suspend vibration of said feeding module.

* * * * *